United States Patent [19]

Thompson, Jr.

[11] 4,274,068

[45] Jun. 16, 1981

[54] UNDERVOLTAGE PROTECTOR FOR MANUAL MOTOR CONTROLLER

[75] Inventor: Carl Thompson, Jr., Westminster, Md.

[73] Assignee: Gould Inc., Rolling Meadows, Ill.

[21] Appl. No.: 52,289

[22] Filed: Jun. 26, 1979

[51] Int. Cl.[3] ..... H01H 73/06

[52] U.S. Cl. ..... 335/20; 335/155

[58] Field of Search ..... 335/20, 155

[56] References Cited

U.S. PATENT DOCUMENTS

| | | | |
|---|---|---|---|
| 4,075,584 | 2/1978 | Castonguay et al. | 335/20 |
| 4,166,260 | 8/1979 | Gillette | 335/20 |

*Primary Examiner*—Harold Broome

*Attorney, Agent, or Firm*—Harold Huberfeld; Bernard Gerb; Jerome M. Berliner

[57] ABSTRACT

A manual motor starter having a current responsive automatic trip means is provided with an undervoltage trip device. The latter includes a solenoid having a plunger biased to operate a lever into tripping engagement with the automatic trip means when the solenoid plunger is magnetically released. While the biasing means is strong enough so that the kinetic energy of the plunger when released from its magnetically held-in position is sufficient to trip the starter, the biasing means is not strong enough to prevent resetting of the trip means after restoration of operating voltage.

10 Claims, 5 Drawing Figures

UNDERVOLTAGE PROTECTOR FOR MANUAL MOTOR CONTROLLER

This invention relates to undervoltage trip devices in general and more particularly relates to a device of this type utilized particularly with manual motor controllers.

U.S. Pat. No. 3,518,597 issued June 30, 1970 to E. T. Platz et al. for A Manual Motor Starter describes the construction and operation of a manual motor starter or controller which includes overcurrent responsive automatic trip means. When this type of controller is closed and there is a loss of primary power the controller will not trip to the open, or motor off, position. This sometimes leads to a situation wherein the load is reenergized as soon as power returns even though motor operation may not be desired at this time. Further, it is preferable to restore power when few loads are connected to the line.

In order to overcome the foregoing condition, the instant invention provides an undervoltage trip device that may readily be added to existing motor controllers so that the latter will automatically trip when there is a loss of primary power. The undervoltage trip device is of simplified construction and resets without the necessity of mechanical manipulation of controller elements. Further, the undervoltage trip device is mounted outside of the controller housing, with a trip crank or lever of the undervoltage trip device extending through a side opening in the controller housing for engagement with the common trip bar of the controller.

The undervoltage trip device includes a solenoid having a plunger biased toward released position by a spring whose force is insufficient to prevent manual resetting of the controller. However, upon the occurrence of an undervoltage condition, this spring acts on the plunger to move the same with sufficient speed so that its kinetic energy acting on the trip lever is sufficient to release the automatic trip means of the controller, causing contacts of the latter to open.

Accordingly, a primary object of the instant invention is to provide a novel undervoltage trip device for use with a manual motor controller.

Another object is to provide an undervoltage trip device of this type which is of simplified construction and may readily be connected to existing motor controllers.

Still another object is to provide an undervoltage trip device of this type which resets without the necessity of manipulating movable elements of the controller.

A further object is to provide an undervoltage trip device of this type having a single operating spring which moves a solenoid plunger upon release thereof so that the kinetic energy of the plunger is sufficient to cause tripping of the associated motor controller, yet the force of this biasing spring is insufficient to prevent resetting of the controller contact operating mechanism.

These objects as well as other objects of this invention shall become readily apparent after reading the following description of the accompanying drawings in which.

Figure 1:
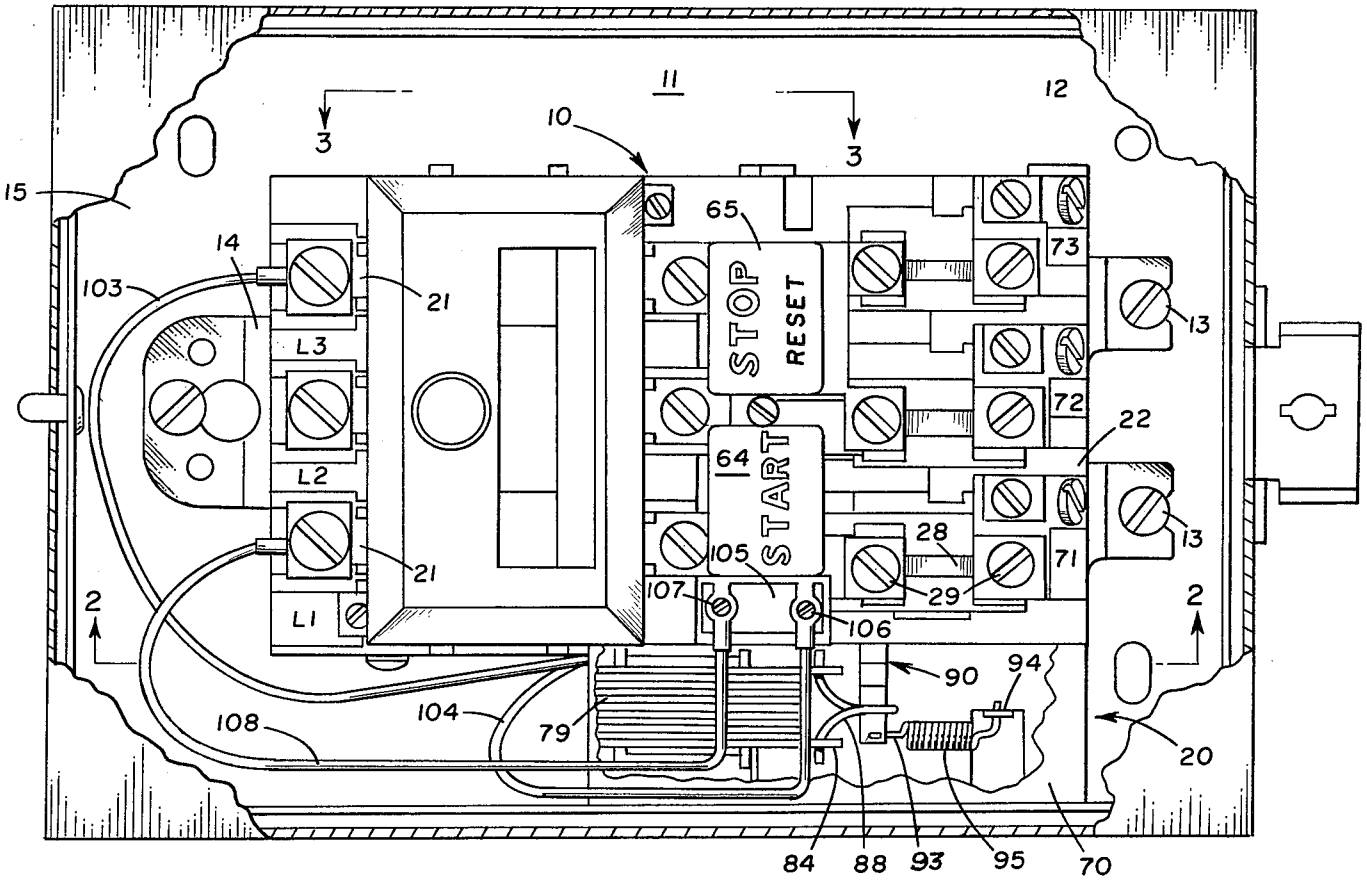
FIG. 1 is a front elevation of a manual motor controller having the undervoltage trip device of the instant invention mounted thereto.

Now referring to the Figures. In FIG. 1 motor controller 10 and undervoltage trip device 20 are shown mounted within enclosure 11 having openable front cover 12. Only the rearwardly extending rectangular lip and corners of cover 12 are shown. Three screws 13 extend through metal mounting plate 14 of controller 10 to secure the latter to the front surface of housing rear wall 15. The construction and operation of controller 10 is described in detail in the aforesaid U.S. Pat. No. 3,518,597.

Briefly, controller 10 includes molded insulating housing 16 disposed in front of mounting plate 14 and secured thereto by a plurality of screws 17. Controller 10 is a three pole unit, each pole of which is provided with substantially the same current carrying elements so that only one pole shall be described. More particularly, the current path through each pole consists of line terminal 21, stationary contact 23 mounted to line terminal 21, bridging contact 24 to stationary contact 25 mounted at one end of strap 26, strap 27, and U-shaped heater 28 to load terminal 22. The free ends of the heater arms are outwardly turned and are secured by screws 29, 29 to strap 27 and load terminal 22.

Heater 28 extends between the arms of U-shaped bimetal 30 having one end secured to rigid L-shaped strap 31 which is secured to insulating block 32 by screw 33. Bimetal 30 is the sensing element of an overcurrent responsive automatic trip means of a type well known to the circuit breaker art. In particular, when bimetal 30 is heated its free end moves to the left with respect to FIG. 2 and engages protrusion 34 on transverse common trip bar 35 to pivot the latter counterclockwise about its pivot 36 causing main latch 37 carried by bar 35 to release forward extension 38 of auxiliary latch 40. The latter is a U-shaped member mounted on pivot 39 and biased by torsion spring 41 in a clockwise or tripping direction to the tripped position of FIG. 2. Spring 58 (FIG. 3) biases trip bar 35 clockwise with respect to FIG. 2 toward the reset position of main latch 37 seen in FIG. 3. When auxiliary latch 40 is held in its latching position through the engagement of main latch 37 with extension 38, cradle latching tip 43 is held in its reset position to the rear of auxiliary latch web 42.

Auxiliary latch 40 is disposed between the forwardly extending arms of U-shaped frame 46 which is secured to plate 14 by rivets 48, with the web of frame 46 adjacent the front surface of plate 14. Pin 47 also extends between the arms of frame 46 and provides a fixed pivot for cradle 45 located at the end thereof remote from latching tip 43. Cradle 45 is also provided with reset pin 49 and spring retainer 51 disposed forward of pin 49. Two contact operating springs 52 extend between retainer 51 and holes in carrier actuator 50. The latter is a U-shaped member mounted between the rearwardly extending arms of U-shaped main actuator 55, being pivotally mounted to the latter on inward embossments 53. Aligned rivets 56 pivotally mount main actuator 55 to frame 46 between the forwardly extending arms thereof. The end of carrier actuator 50 remote from pivot embossments 53 is in operative engagement with guide bracket 59 secured to the rear of insulating contact carrier 60. Movable bridging contacts 24 of all three poles are mounted on carrier 60 at the front thereof. Guide 59 is slidably mounted on post 61 extending forward from plate 14.

Figure 2:
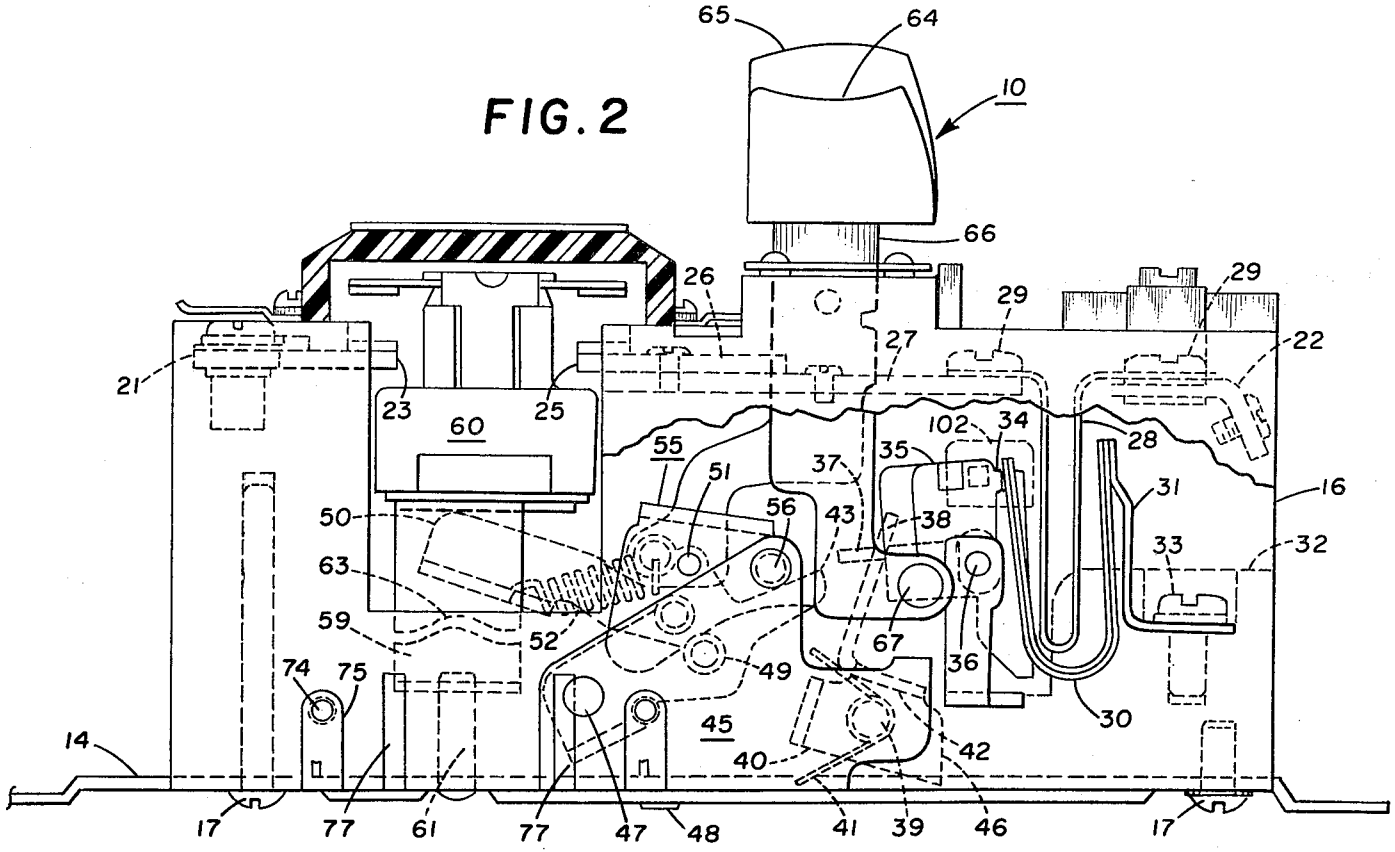
FIG. 2 is a side elevation of the motor controller looking in the direction of arrows 2—2 of FIG. 1, with a substantial portion of the housing broken away to reveal internal elements.
Figure 3:
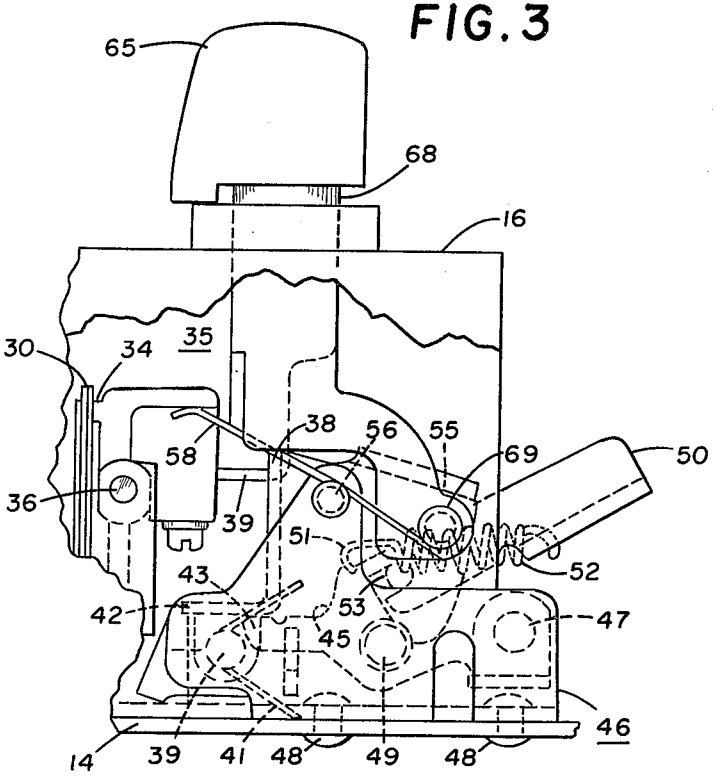
FIG. 3 is a fragmentary side elevation at the center pole of the motor controller looking in the direction of arrows 3—3 of FIG. 1.
Figure 5:
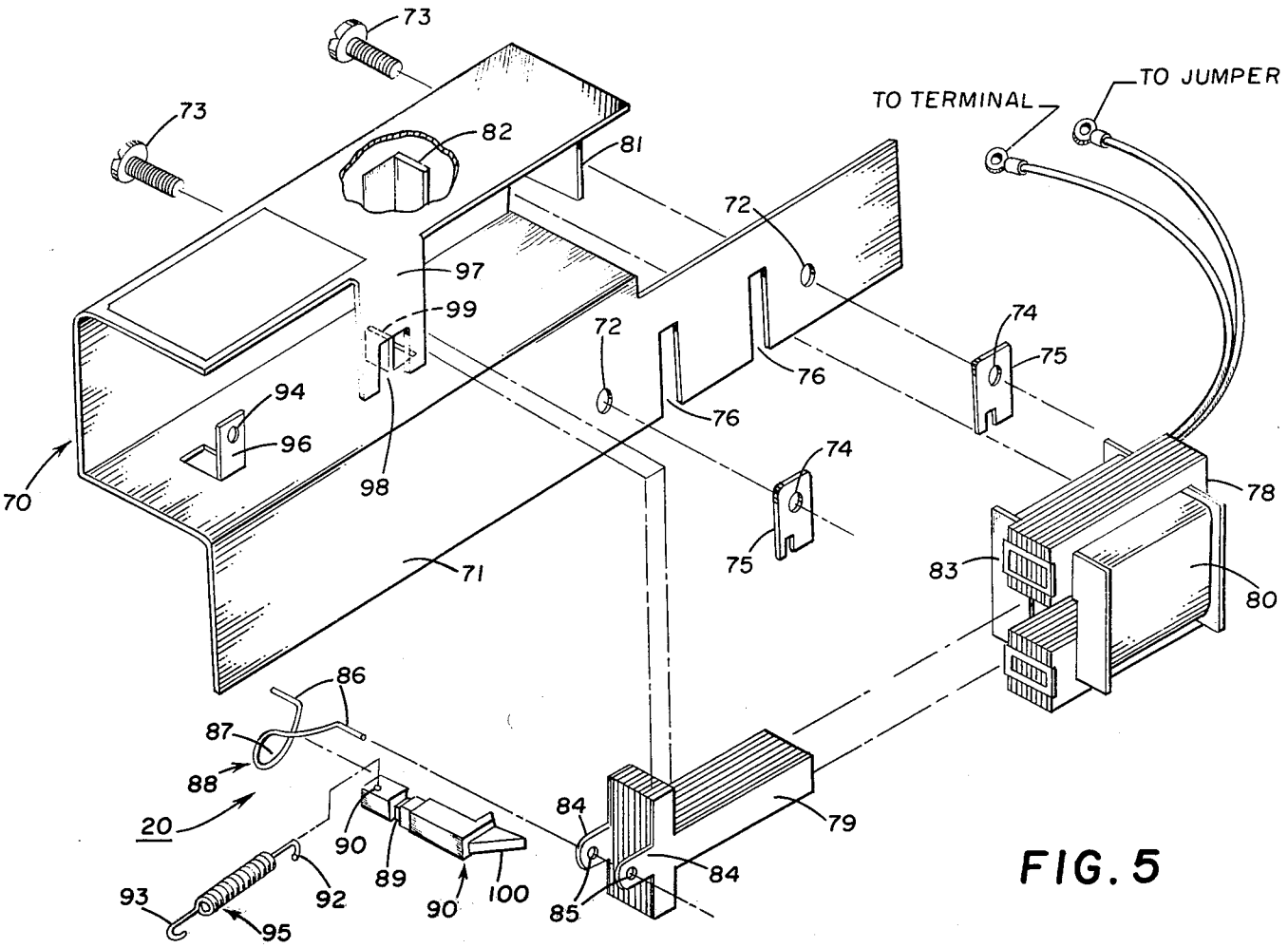
FIG. 5 is an exploded perspective of the undervoltage trip device.

It should now be apparent to those skilled in the art that when cradle 45 is in its latched position of FIG. 3, repositioning pivot 53 by pivoting main actuator 55 clockwise from its position shown in FIG. 2 will cause the end of carrier actuator 50 remote from its pivot 53 to move rearward, engaging web 63 of bracket 59 to move the latter together with carrier 60 and contact 24 rearward so that the latter engages space stationary contacts 23, 25 to close the main current circuit through controller 10.

Pivoting or rocking motion of main actuator 55 about its pivot 56 is accomplished by depressing (rearwardly moving) the respective Start and Stop buttons 64, 65. Rearward motion of Start control 64 is transmitted through link 66 and rivet 67 to main actuator 55 causing the latter to pivot clockwise about its pivot 56 (as viewed in FIG. 2) and moving pivot 53 carried thereby forward of the line of action for springs 52 so that the end of carrier actuator 50 in engagement with bracket 59 moves rearward. Conversely, when Stop control 65 is depressed (moved rearward), this motion is transmitted through link 68 and rivet 69 (FIG. 3) to pivot main actuator 55 counterclockwise (as viewed in FIG. 2) to move carrier actuator pivot 53 to the rear of the line of action for springs 52 whereby the latter pivots carrier actuator 50 to the open circuit position shown in FIG. 2. As is well known to the art, with releasable cradle 45 in its released or tripped position of FIG. 2, depressing Start button 64 will be ineffective to operate bridging contact 24 into engagement with stationary contacts 23, 25.

Undervoltage protector 20 is provided with formed sheet metal housing 70 having rearwardly extending flange 71 with two clearance apertures 72 through which mounting screws 73 extend to threadably engage apertures 74 in inserts 75 secured in controller housing 16. Slots 76 in flange 71 cooperate with embossments 77 at the side of housing 16 to operatively position housing 70 with respect to housing 16 prior to tightening of mounting screws 73 which hold device 20 in operative position secured to one side of controller 10.

Undervoltage protector device 20 also includes a solenoid consisting of stationary U-shaped yoke 78, T-shaped armature or plunger 79, and operating coil 80. The latter is straddled by the parallel legs of yoke 78 and provides a guide passage for linear movement of plunger 79. Yoke-coil assembly 78, 80 is maintained in fixed position within housing 70 by end tab 81 and lanced ear 82 with the latter engaging coil bobbin 83 and the former engaging the leg of yoke 78 remote from plunger 79. The outer laminations of armature 79 are each provided with ears 84 having aligned apertures 85 which receive the outturned ends 86 of link 88 formed of spring wire material. The central portion of link 88 is bent to form loop 87 which surrounds crank or lever member 90 at circumferential depression 89 thereof.

The end of lever 90 remote from controller 10 is provided with aperture 91 which anchors end 92 of coiled tension spring 95. The other end 93 of spring 95 is received by aperture 94 in ear 96 formed integrally with housing 70.

Figure 4:
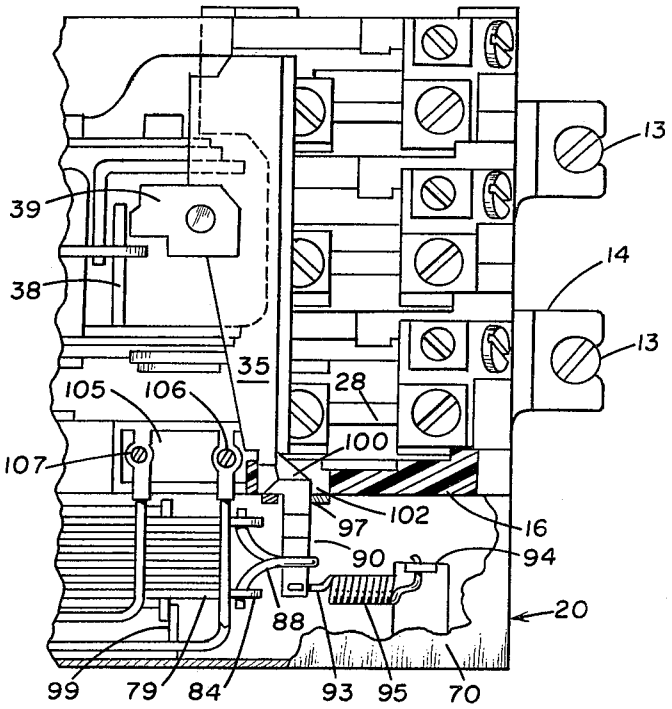
FIG. 4 is a front elevation showing the mechanical cooperation between the undervoltage trip device and the automatic trip means of the motor controller.

Housing tab 97 lies generally in the same plane with mounting flange 71. The free end of tab 97 is provided with notch 98 which receives lever 90 near the end thereof remote from aperture 91 and more distant from notch 89 than is aperture 91. Ear 99 formed integrally with housing 70 provides a stop which engages plunger 79 to limit outward movement thereof under the influence of spring 95. The end 100 of lever 90 remote from aperture 91 extends outward of housing 70 and through aperture 102 (FIG. 4) of controller housing 16 to the interior of the latter in operative position adjacent, trip bar 35 at a point forward of pivot 36 so that spring 95 biases lever 90 toward tripping engagement with bar 35. That is ear 97 acts as a pivot for lever 90 and the force exerted by spring 95 is to the right with respect to FIG. 4 thereby biasing lever 90 in a counterclockwise direction so that end 100 thereof moves toward common trip bar 35 and tends to pivot the latter against the force exerted by reset spring 58 (FIG. 3).

Leads 103, 104 extending from opposite ends of solenoid coil 80 are connected respectively to the line terminal 21 labeled "L3" in FIG. 1 and to conducting strap 105 at binding screw 106. Binding screw 107 connects one end of lead 108 to strap 105 and the other end of lead 108 is connected to the line terminal 21 labeled "L1" in FIG. 1. Thus, when primary power is available at line terminals 21 for controller 10, solenoid coil 80 is energized and plunger 79 is pulled in or to the left with respect to FIG. 4. This causes spring 95 to be extended or loaded in that link 88 connects plunger 79 to lever 90 so that the latter pivots clockwise causing spring end 93 to move to the left with respect to FIG. 4.

When primary power is lost or the voltage thereof drops below a predetermined level there is insufficient flux generated by current flowing in solenoid coil 80 to magnetically hold in plunger 79 against the force exerted by spring 95. Under these circumstances the energy stored in spring 95 moves armature 79 toward its stop 99. The kinetic energy of the moving plunger 79 is transmitted to pivot lever 90 counterclockwise with respect to FIG. 4 so that lever end 100 engages common trip bar 35 to pivot the latter about pivot 36, in latch releasing direction, against the force exerted by spring 58 (FIG. 3). It is noted that the force derived from the kinetic energy of moving armature 79 and applied to lever 90 is multiplied before being applied to common trip bar 35 in that pivot tab 97 is much closer to lever end 100 than to the point where link 88 is secured to lever 90.

Even though the energy stored in spring 95 moves plunger 79 with sufficient rapidity so that the kinetic energy thereof will operate common trip bar 35 to its tripped position, after tripping has taken place the energy exerted by spring 95 is insufficient to prevent relatching of trip bar 35.

Even though solenoid coil 80 is shown as being connected to line terminals 21 of motor controller 10, in order to conserve energy solenoid 80 may be connected to load terminals 22 of controller 10.

Device 20 may serve a dual purpose. That is, it may function as an undervoltage device, as previously described, and at the same time may be utilized as a shunt trip device. The latter is accomplished by removing jumper strap 105 and connecting a remotely located normally closed switch (not shown) to terminal screws 106, 107. By selectively opening such switch solenoid coil 80 will be deenergized thereby releasing plunger 79 so that tripping of common trip bar 35 will take place in the manner herein before described, even though line voltage remains at terminals 21.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. Electrical switching apparatus including a controller and a trip unit for automatically opening said controller when operating voltage applied to the latter falls below a predetermined level; said controller including cooperating contact means, an operating mechanism for selectively opening and closing said contact means, automatic trip means which when actuated by detecting the occurrence of predetermined fault current conditions releases said mechanism whereby the latter opens said contact means; said trip unit comprising an electromagnet having an armature mounted for movement between first and second positions, an operating coil which when energized at a predetermined level by voltage applied to said controller generates magnetic flux in said armature which holds the latter in said first position, biasing means urging said armature toward said second position, means operatively engaging said armature with said automatic trip means for actuating the latter while said armature is being moved by said biasing means from said first to said second position, with said armature resting generally at said second position said biasing means being ineffective to prevent automatic resetting of said trip means when said operating voltage again rises above approximately said predetermined level.

2. Electrical switching apparatus as set forth in claim 1 in which the means operatively engaging the armature with the automatic trip means includes a lever mounted to produce a multiplied force that is derived from movement of said armature from said first to said second position; said multiplied force appearing at said trip means to actuate the latter.

3. Electrical switching apparatus as set forth in claim 2 in which the controller includes a housing wherein said contact means, said operating mechanism and said trip means are disposed; said electromagnet and said biasing means being disposed externally of said housing; said lever extending through an opening in said housing.

4. Electrical switching apparatus as set forth in claim 3 in which the trip unit is constructed as a subassembly mounted alongside said housing.

5. Electrical switching apparatus as set forth in claim 2 in which the biasing means includes a coiled tension spring having one end connected to said lever; a link connecting said armature to said lever; said link and said spring extending in opposite directions from said lever.

6. Electrical switching apparatus as set forth in claim 5 in which the lever is mounted on a pivot means disposed closer to a first end of said lever than to its second end; said second end of said lever being engageable with said trip means for actuation thereof; said link and said spring being more remote from said pivot means than is said second end.

7. Electrical switching apparatus as set forth in claim 6 in which the spring is more remote from said pivot means than is said link.

8. Electrical switching apparatus as set forth in claim 1 in which loading of said biasing means increases as said armature moves from said second to said first position.

9. Electrical switching apparatus as set forth in Claim 1 in which the biasing means is essentially unloaded when said armature is at said second position.

10. Electrical switching apparatus as set forth in claim 4 in which the subassembly includes support means secured to said housing; said support means defining an auxiliary housing wherein said electromagnet and said biasing means are disposed; said biasing means including a coiled tension spring connected at opposite ends thereof to said crank and said auxiliary housing; said coil being fixedly mounted in said housing; said armature comprising a plunger mounted for axial movement in a passage surrounded by said coil; and a formed wire link connecting said armature to said lever.

* * * * *